United States Patent [19]

Jennings

[11] Patent Number: 4,562,824

[45] Date of Patent: Jan. 7, 1986

[54] COMPOUND BOW

[75] Inventor: Thomas P. Jennings, Sun Valley, Calif.

[73] Assignee: Kidde Recreation Products, Inc., North Brook, Ill.

[21] Appl. No.: 577,897

[22] Filed: Feb. 7, 1984

[51] Int. Cl.[4] ..... F41B 5/00

[52] U.S. Cl. ..... 124/23 R; 124/DIG. 1

[58] Field of Search ..... 124/23 R, 24 R, DIG. 1

[56] References Cited

U.S. PATENT DOCUMENTS

| | | | |
|---|---|---|---|
| 3,851,638 | 12/1974 | Alexander | 124/24 R |
| 3,854,467 | 12/1974 | Hofmeister | 124/24 R |
| 3,923,035 | 12/1975 | Trotter | 124/24 R |
| 3,967,609 | 7/1976 | Frydenlund | 124/24 R |
| 3,987,777 | 10/1976 | Darlington | 124/23 R |
| 4,077,385 | 3/1978 | Fredrickson | 124/24 R |
| 4,203,412 | 5/1980 | Rickard | 124/23 R |
| 4,207,858 | 6/1980 | Blackstone | 124/23 R |
| 4,287,867 | 9/1981 | Islas | 124/24 R |
| 4,365,611 | 12/1982 | Nishioka | 124/24 R |
| 4,461,267 | 7/1984 | Simonds et al. . | |
| 4,478,203 | 10/1984 | Hayes | 124/24 R |

OTHER PUBLICATIONS

Simonds—Pat. Appln. Ser. No. 402,245—Filed 7-2-7-82, Allowed 1-30-84.

*Primary Examiner*—Richard C. Pinkham
*Assistant Examiner*—Benjamin Layno
*Attorney, Agent, or Firm*—Emory L. Groff, Jr.

[57] ABSTRACT

A compound bow includes a single, integrated cam assembly supported by the bow handle and having separate, adjacent cam elements receiving string cable segments and power cable segments from the bow limb tips. All the cam elements are fixedly disposed relative one another and are mounted for arcuate displacement as a unit. The plurality of cam elements and attendant bow structure are disposed in a manner resulting in shortened limb tip travel for a given bowstring displacement. The draw length of the bow is readily altered without dismantling the bow cable components and without any tools by removing and relocating end portions of the power cables in selected ones of a plurality of retainer pockets in the cable assembly and further draw length modification is obtainable, without changing the bow peak draw weight, through interchangable power cable cams.

18 Claims, 5 Drawing Figures

COMPOUND BOW

This invention relates generally to archery bows and more particularly to a compound bow having a unique unitary or integrated cam assembly provided with programmed cam elements resulting in an improved performance.

As is well known to those skilled in the archery art, the draw force of a compound bow increases during the early portion of the draw and usually reaches a peak shortly past the mid-point of the draw, after which the draw force continually decreases as the bow is fully drawn, thereby enabling the archer to more readily hold the bowstring/arrow during the critical aiming and release stage. This action is obtained through the use of one or more pairs of eccentric/concentric wheels and/or cam elements and to date, numerous bows have been produced using various combinations of these components in attempts at providing compound bows with improved performance.

A desirable feature in the design of any compound bow is to provide the shortest amount of limb tip travel for a given bowstring displacement. When this is achieved, less recoil is produced as less inertia is generated during movement of the limb tips while a shorter limb stroke also reduces the amount of bend in the limb for a given draw length therefore reducing the possibility of core shear in the limbs. Along the same lines, it is desirable to minimize the mass carried by the bow limb tips. and in this respect, many compound bow designers prefer to avoid any eccentric cam or wheel members carried by the bow limb tips. U.S. Pat. No. 3,854,467 issued Dec. 17, 1974 to Hofmeister exemplifies a compound bow wherein only concentric wheels are carried by the limb tips while a plurality of cam elements are fixedly mounted relative the opposite ends of a rigid bow handle section. Such an arrangement has been quite popular yet introduces another problem namely, the need for means synchronizing the arcuate displacement of the two separate eccentric cam assemblies.

An example of a further attempt to improve the construction of a compound bow will be found in U.S. Pat. No. 4,203,412 issued May 20, 1982 to Rickard and which discloses a single cam assembly carried by a bow handle section and which cooperates with separate power and string cables leading to the two bow limb tips. With the instant arrangement, increased performance is achieved along with a simplified construction enabling ready tuning.

By the present invention, an improved compound bow is offered having a single, integrated cam assembly which not only eliminates the need for a synchronizing system but also provides a plurality of power cable and string cable cam elements fixedly attached relative one another and arcuately displaceable as a unit about a single pivot axle rigidly mounted relative the bow handle section. In effect, only one cable system is involved and subject to a need for balancing, as opposed to as many as five cable systems in other compound bows. The present cam assembly provides for quick and simple draw length modification by the user in the field and even more importantly, once an archer custom tunes the present bow, it more consistently holds this tune than do many other compound bows on the market.

Accordingly, one of the objects of the present invention is to provide an improved compound bow having a single, integrated cam assembly mounted upon a single pivot axle carried by the bow handle section.

Another object of the present invention is to provide an improved compound bow having a unitary cam assembly provided with a plurality of string cable and power cable programmed cam elements normally fixedly disposed relative one another.

Still another object of the present invention is to provide an improved compound bow including a unitary cam assembly provided with a pair of upper power cable and string cam elements and a pair of lower power cable and string cable cam elements with selective positioning means formed in all of the cam elements for modifying the adjustment of each cable relative its respective cam element.

A further object of the present invention is to provide an improved compound bow including a single, integrated cam element assembly having a plurality of string cable and power cable cam elements with means enabling ready replacement of the power cable cam elements for altering the profile thereof and thus obtaining different draw lengths.

With these and other objects in view which will more readily appear as the nature of the invention is better understood, the invention consists in the novel construction, combination and arrangement of parts hereinafter more fully described, illustrated and claimed.

Similar reference characters designate corresponding parts throughout the several figures of the drawings.

Figure 1:
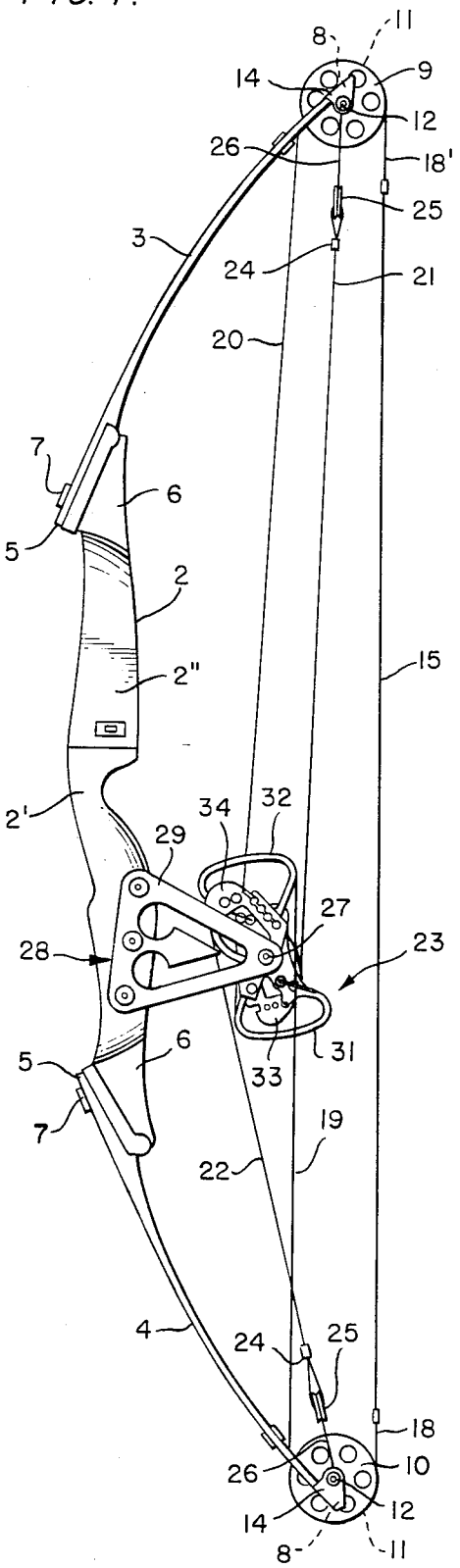
FIG. 1 is a side elevation of a compound bow according to the present invention.

Referring now to the drawings, particularly FIG. 1, the present invention will be understood to relate to a compound bow, generally designated 1 and which includes a central handle section 2 from which extend an upper limb 3 and lower limb 4. The handle section 2 may be constructed of any suitable material which is substantially rigid such as metal, wood, plastics or a combination thereof while the appended limbs 3–4, which likewise may be fabricated of any suitable well known material, are somewhat flexible or resilient. The handle section includes a suitable hand grip 2' below a sight window 2'' the latter of which preferably extends inwardly past the plane of the bow centerline, for reasons which will be clearly appreciated by those skilled in this art. The inner end 5 of each limb is preferably removably attached to the outer ends 6 of the handle section 2 and may include adjustable means, such as the fittings or bolts 7, to enable selective variations of the bow draw weight as is well known.

Figure 2:
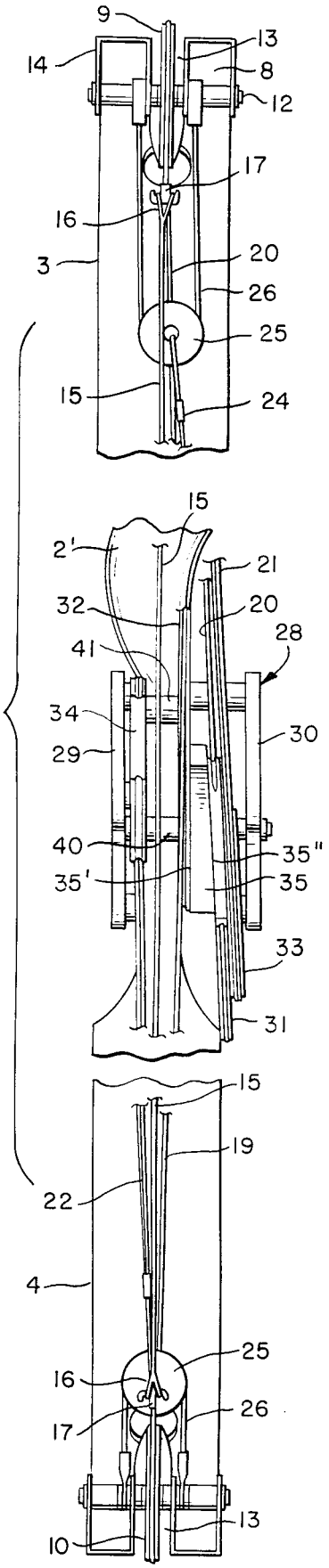
FIG. 2 is an enlarged, fragmentary rear elevation of the bow of FIG. 1 illustrating the lateral relationship between the plurality of cam elements of the cam assembly.

The outer limb tips 8 serve to support an upper wheel 9 and lower wheel 10 which will be understood to comprise a circular member provided with a peripherial cable/string groove or track 11. Each wheel 9–10 is concentrically mounted for arcuate displacement adjacent a respective bow limb tip 8 by means of an axle 12 as shown in FIG. 1–2. The wheels are disposed in a split or crotch 13 formed in the distal portion of each bow limb 3–4. Alternate wheel mounting means may, of course, be utilized such as a separate U-shaped bracket (not shown) but such a mounting device is preferably avoided in view of the extra mass which then would be carried by the bow limb tips. The wheel axles 12 are illustrated as being supported in a fixed manner relative the limb tips by means of pairs of limb tip hangers 14 comprising shaped metal or plastic members forming a boot overlying the respective limb tips 8 and supporting the opposite ends of each wheel axle 12 with one wheel 9 or 10 carried by each axle between a pair of the limb tip hangers.

Spanning the greater part of the distance between the opposed wheels 9–10 is the bowstring 15, terminating in opposite loops 16–16 adapted to releasably engage cable fittings 17 carried by the cable portion 18 or 18′ of each one of a pair of string cables 19 and 20. The two string cables 19 and 20, together with a pair of power cables 21 and 22, will be understood to cooperate with a single, integrated cam assembly generally designated 23. The lower string cable 19 will be seen to extend from one end of the bowstring 15 around the lower concentric wheel 10 and terminates at the cam assembly 23 while the upper string cable 20 extends from the top end of the bowstring 15, around the upper concentric wheel 9 and terminates at the cam assembly 23. The power cables extend from points adjacent the two concentric wheels to the cam assembly 23 and comprise an upper power cable 21 and lower power cable 22, both extending from the cam assembly to the two limb tip axles 12—12. To maximize the useful life of the power cables, each preferably comprises a dual cable construction.

As shown most clearly in FIG. 2 of the drawings, the two concentric wheels 9–10 are centrally disposed with respect to the vertical bow centerline so that the bowstring 15 is at all times maintained coplanar with the bow centerline. Although the terminus of at least certain of the power and string cables at the cam assembly are intentionally laterally of the centerline, the portions of these cables juxtaposed the bow limb tips will be seen to fall within the centerline plane. This coplanar relationship between the strings and cables and the bow centerline is important so as to minimize any unequal torque being applied to the limb tips during use of the bow. As will be seen in FIG. 2, the outer ends 24 of the two power cables 21–22 are preferably pivotally connected to the respective axles 12 by a yoke arrangement comprising a cable button or disc 25 which in turn is joined to the axle 12 by a U-shaped bridle cable 26 such that the adjacent cable ends 24 effectively apply a balanced force upon the limb tips 8.

The heart of the present invention comprises the integrated cam assembly 23 which regulates the forces and displacement of the various cables relative the displacement of the resilient limbs 3–4. The cam assembly 23 will be seen to comprise a unitary assembly which is carried by a single transverse axle 27 in turn supported at one end of a pylon or bracket assembly 28. This assembly includes a pair of side arms 29,30 suitably attached to opposite sides of the lower portion of the central handle section 2 immediately beneath the hand grip 2′. To assist in overcoming friction generated by the high loads applied upon the axle 27, ball bearings B may be provided in the free ends of each side arm 29,30 with the axle ends retained by appropriate clips 27′.

Figure 5:
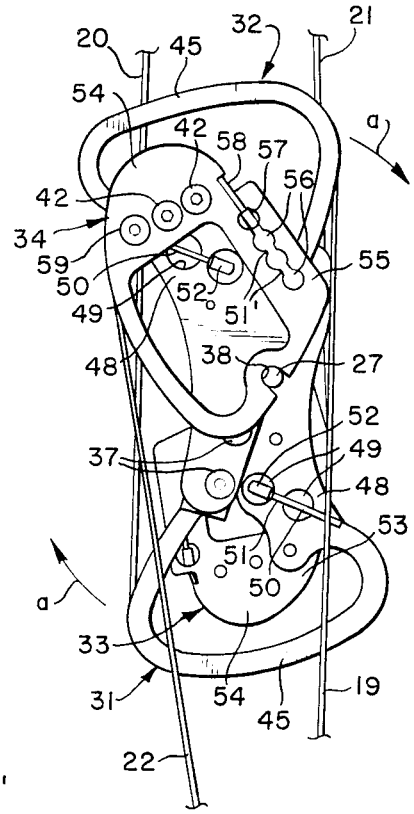
FIG. 5 is a side elevation of the cam assembly of FIGS. 3 and 4.

During operation of the compound bow 1, the entire cam assembly 23 will be understood to undergo an arcuate displacement of substantially less than 180 degrees between the at-rest position of FIGS. 1 and 5 and the full draw position with this displacement occurring in the direction of the arrows a—a in FIG. 5.

The various cam elements of the present invention are identified herein not by their relative location when the cam assembly 23 is in any one position, but according to the particular string or cable which is sheaved about that cam element. With this in mind, the cam assembly comprises an upper string cam 31 extending downwardly from the cam assembly axle 27 and an oppositely extending lower string cam 32 projecting upwardly from the axle 27. Adjacent the upper string cam 31 is an upper power cam 33 while adjacent the lower string cam 32 is a lower power cam 34. As previously mentioned, the cam assembly is a unitary device that is, during use, the plurality of components thereof are relatively fixed with respect to each other as the assembly is pivotally displaced during operation of the bow.

Figure 3:
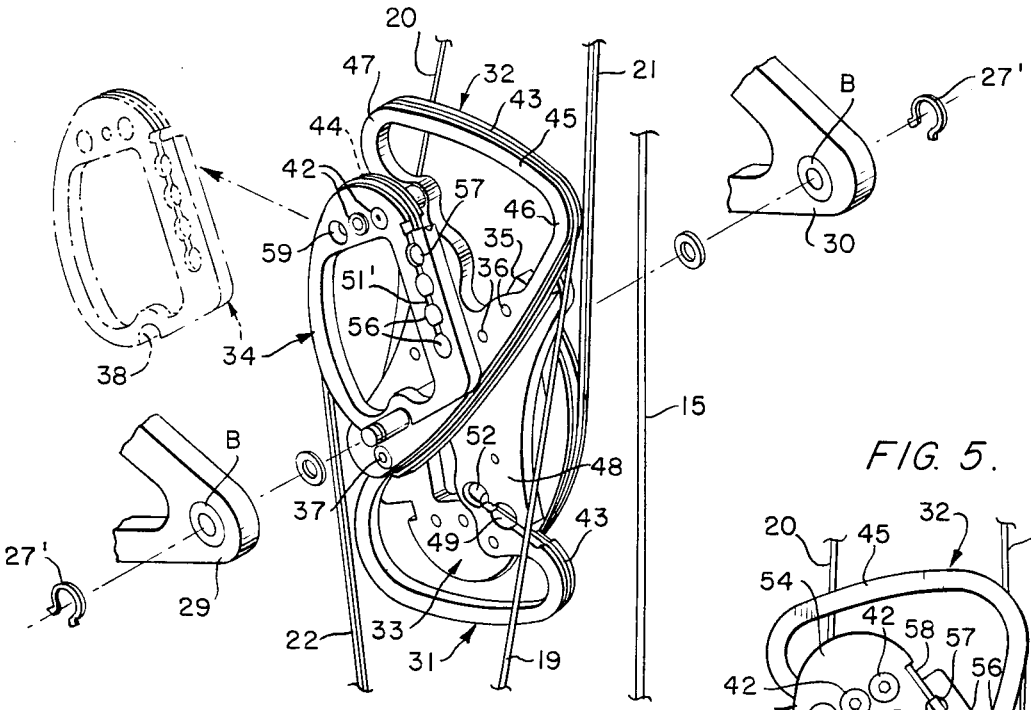
FIG. 3 is an enlarged partially exploded rear perspective view of the cam assembly as it appears when the compound bow is in the at-rest position.
Figure 4:
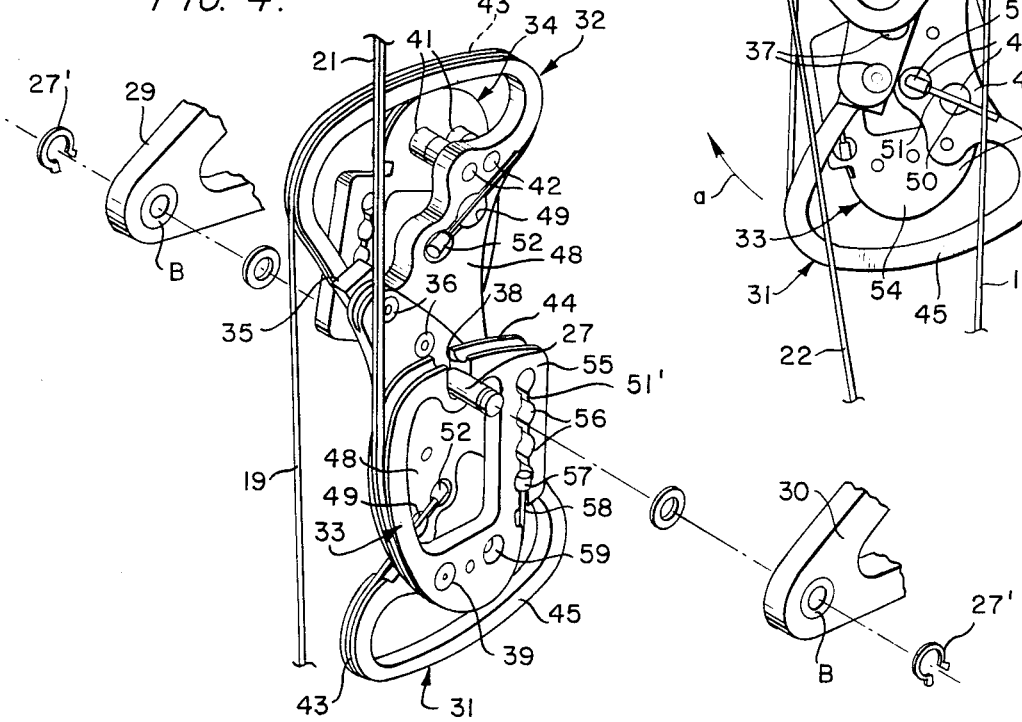
FIG. 4 is a perspective view illustrating the cam assembly of FIG. 3 as it appears from the opposite side.

For ease of fabrication as well as to facilitate assembly and replacement of components thereof, the two string cam elements 31–32 which from FIGS. 2–4 will be seen to be disposed in laterally adjacent planes, are separate members respectfully attached to a centrally disposed mounting block 35. Suitable fasteners 36 (FIG. 4) releasably attach the upper string cam 31 to the mounting block 35 while similar fasteners 37 (FIG. 5) separately attach the lower string cam 32 to the same mounting block 35. The construction and disposition of the various cam elements 31–34 in addition to providing an improved bow performance, also obviates the need for a cable guard to deflect the power and string cables away from the plane of the sight window 2″. With the present cam assembly 23, both the upper string cable 20 and upper power cable 21 pass well to the right of the plane of the sight window 2″. This disposition is achieved in view of the mounting block 35 which from FIG. 2 will be seen to be mounted on the axle 27 to the right of the bow centerline. In the at-rest position of FIG. 2, the mounting block 35 presents a vertical inner face 35′ supporting the lower string cam 32 and an upwardly and inwardly tapered or inclined outer face 35″ to which the upper string cam 31 is attached.

The two power cams 33–34 are adapted to be readily removed and adjustably fixed relative the two string cams so as to allow for alteration of the angular disposition between the power and string cam elements to alter the draw length of the associated bow. Even greater modification of this parameter is readily achieved by replacing a given programmed power cam with an entirely differently programmed set of power cams and this modification is readily achieved in the field in view of the present releasable construction. As shown in FIGS. 2–5 of the drawings, the two power cams 33–34 are mounted outside of the respective string cams 31–32 and are fixedly secured relative thereto by fastener means entirely independent of the fasteners 36–37 serving to maintain the two string cams mounted upon the cam assembly axle 27. The upper power cam 33 and lower power cam 34, each include a slotted aperture 38 at one end thereof which is adapted to be radially installed in mating engagement with the periphery of the cam assembly axle 27 as depicted in FIG. 3.

To preclude unwanted pivotal displacement of the power cams and to secure them in the installed position separate fastener means are employed. In the case of the upper power cam 33, this cam will be seen from FIGS. 2 and 4 to flushly engage the outer face of the upper string cam 31 and this position is maintained by means of a fastener 39 freely passing through the lower portion of the upper power cam and into the lower portion of the upper string cam 31. In the case of the lower power cam 34, it will be noted in FIGS. 2 and 3 that this cam is laterally spaced from the outer face of the lower string cam 32. Thus, an appropriate spacer sleeve 40 carried by the cam assembly axle 27 maintains the slotted portion of the lower power cam properly spaced from the lower string cam while a pair of sleeves 41 serve to house fasteners 42 anchored in the lower string cam 32 to angularly and laterally lock the lower power cam 34 with respect to the remaining structure of the cam assembly.

The various adjustments available by means of the preceding described arrangement will be explained following a further description of the individual cam elements and their relationship to the various bowstrings and cables. Each of the four cams 31, 32, 33, 34 comprises a substantially planar elongated member located between the plyon assembly side arms 29,30. The lower string and power cams 32,34 are thus disposed perpendicular to the horizontally disposed cam assembly axle 27 while the upper string and power cams 31,33 will be slightly inclined in view of their attachment to the inclined outer face of the mounting block 35. Each string cam 31–32 is provided with a track or groove 43 extending about a substantial portion of is periphery while each power cam 33–34 is provided with a modified track or groove 44 to accommodate the dual strands of each power cable. The string cams 31–32 each include an outermost lobe 45 defining greatest horizontal extent of the string cams. Tracing the path of the string cables, it will be observed that the lower string cable 19 passes upwardly from the lower wheel 10 to engage the track 43 of the lower string cam outermost lobe 45 while in the case of the upper string cable 20, the latter cable will be observed to engage the track 43 of the upper string cam 31 at a point adjacent the forward portion 47 of its outermost lobe 45.

Each of the four cam elements 31, 32, 33 and 34 include a base section located inwardly of the respective outermost lobe and closer to the cam assembly axle 27. In the case of the string cams 31–32, a base section 48 is shown and which includes a plurality of pockets or sockets 49 shown most clearly in FIGS. 3–5 of the drawings. These pockets will be understood to serve as retaining means for adjustably securing the end 50 of each string cable 19 or 20 with respect to its associated string cam. To accommodate the cable ends, the pockets are joined by slots 51 leading to the cam track 43. This retention is most readily achieved by providing a fixture or enlargement on the end 50 of the string cables such as the illustrated swaged ball 52 which will be understood to form a close mating fit when positioned within a selected one of the pockets 49.

Tracing the path of the two power cables 21–22 it will be observed that in the case of the upper power cable 21, this cable extends from its bridle attachment to the upper limb 3, downwardly past the horizontal plane of the cam assembly axle 27 and engages the track 44 of the upper power cam 33. The lower end of the upper power cable 21 will be seen to engage the rear portion 53 if the upper power cam outermost lobe 54. The power cable then extends along the track 44 of this cam to the area of its base section 55 and, as in the case of the two string cams, the two power cams are likewise provided with a plurality of adjacent sockets or pockets 56 joined by slots 51' for the adjustable positioning of a swaged ball 57 carried by the end 58 of each power cable. The manner of accomplishing the various adjustments available by means of the structure of the present invention, will be described hereinafter.

With the bowstring as shown in FIG. 1, the combination of the various cam elements forming the cam assembly 23 will be seen to be disposed in an elongated manner having a major axis which is substantially vertical. This is the disposition of the bow components when the bowstring is at brace height. During draw, the two string cables 19–20 engaging their respective string cable cams 31–32 on opposite sides of the cam assembly axle 27, produce an arcuate displacement of the cam assembly in a clockwise direction as viewed in FIG. 1, with a concurrent displacement of the two power cams 33–34. Inasmuch as the respective power cables 21–22 are disposed on opposite sides of the cam assembly axle 27 with respect to their adjacent string cables 19–20, it will be understood that as the string cables rotate the cam assembly in a clockwise direction, the two power cables will be taken up by the respective power cams and this shortening of the power cables will cause flexing of the bow limbs 3 and 4. The resultant draw force curve is generally similar to that which will be well understood by those skilled in the art of compound bows and need not be described in detail for one to appreciate the construction and operation of the instant cam assembly 23.

The draw length of the bow may be readily altered in the field without the need of any tools simply by pulling back upon either of the power cables 21 or 22 at a point intermediate the cam assembly and respective limb tip. This action produces a counter-clockwise displacement of the cam assembly about its axle 27 and concurrently relaxes the tension upon the opposite power cable with sufficient slack being produced therein to allow removal of the slackened power cable end fixture 57 so that the power cable end 58 may be advanced or retracted with the ball 57 being placed in different selected pockets 56. After this alteration, the tension upon the opposite power cable is relaxed and the bow components return to the position such as shown in FIG. 1 of the drawings. In most instances, any change in the end adjustment of one power cable will be followed by a similar adjustment of the other power cable end.

If it is desired to alter the draw length of the bow without changing the peak draw weight thereof, it will be understood that a different pair of power cams having a modified profile must be employed. This is readily achieved by initially disconnecting a respective power cable from an existing power cam in the manner just described. The power cam is then removed from the cam assembly by releasing the fasteners 39 or 42 and thereafter radially moving the power cam to disengage its slotted aperture 38 from about the cam assembly axle 27 such as shown in FIG. 3 of the drawings. A substitute, modified profile power cam is then installed following the same procedure in reverse and after this procedure is followed to replace the opposite cam, the bow will be set up with a different draw length according to the profile of the substituted power cams.

Alternate tuning of the bow is available by changing the relative angular relationship between each power cam and its laterally adjacent string cam. This adjustment is accomplished by first relaxing the tension of each power cable as above described and thereafter removing the fasteners 39 or 42 following which the power cam may be pivoted about the axle 27 and the same fasteners passed through alternate, angularly adjacent opening(s).

Of course, fine tuning may be achieved at any time by means of the weight adjustment fittings 7 and also by utilizing bridle discs 25 which may be provided with a plurality of differently positioned slots for adjustably retaining the outer end 24 of each power cable.

I claim:

1. A compound bow including, a center handle section, upper and lower resilient limbs extending from opposite ends of said handle section and each having an outermost tip, a single integrated cam assembly, attachment means having single pivot means mounting said cam assembly to the lower portion of said handle section, said cam assembly provided with upper and lower string cams and upper and lower power cams, all said cams comprising substantially planar elements, said lower string and power cams disposed in planes substantially close to and on opposite sides of the centerline of the bow, said upper string and power cams substantially offset from and disposed in planes inclined with and on one side of the centerline of the bow, a bowstring having opposite ends and substantially spanning the distance between said limb tips, upper and lower string cables each having opposite ends respectively joined to one said bowstring end and one said string cam, upper and lower power cables each having opposite ends respectively joined adjacent one said limb tip and to one said power cam, means for fixedly connecting said upper and lower string and power cams together as a unitary assembly without any relative pivotal movement between said cams as said cam assembly is displaced about said single pivot means, said fixedly connecting means including removable fastener means affixing said upper power cam on solely one side of said upper string cam and said lower power cam on solely one opposite side of said lower string cam, a profiled track in all said cams receiving said respective string cables and power cables whereby as said bowstring is drawn from an at-rest condition said string cables received in said string cable cam tracks pivotally displace said cam assembly about said single pivot means while concurrently said power cams apply tension to said power cables following which the full bow draw length is achieved as said power cables are further sheaved within said power cam tracks.

2. A compound bow according to claim 1 wherein, said attachment means mounting said cam assembly to said bow includes a pylon assembly affixed to said bow handle section and extending toward said bowstring.

3. A compound bow according to claim 2 wherein, said pylon assembly includes a pair of laterally spaced apart side arms and said single pivot means includes an axle spanning said side arms.

4. A compound bow according to claim 3 including, a handgrip on said handle section, and said pylon assembly disposed beneath said handgrip.

5. A compound bow according to claim 1 including, a wheel concentrically pivotally attached adjacent each said limb tip and each said string cable sheaved about one said wheel.

6. A compound bow according to claim 5 wherein, said wheels are disposed along the centerline of the bow.

7. A compound bow according to claim 1 including, a sight window in said handle section, at least one said string cam and one said power cam mounted on said pivot means and laterally offset from the centerline of the bow whereby said string and power cables joined to said offset cams extend toward one said bow limb tip in planes laterally offset and clear of the plane of said sight window.

8. A compound bow according to claim 1 including, adjustable means to alter the tune of the bow comprising selective means in said power cams for lengthening/shortening said power cable ends joined to said power cams.

9. A compound bow according to claim 8 wherein, said selective means includes a plurality of spaced apart pockets in said power cams and an enlargement on one end of each said power cable removably insertable in any one said pocket.

10. A compound bow according to claim 8 including, selective means in said string cams for lengthening/-shortening said string cable ends joined to said string cams.

11. A compound bow according to claim 1 wherein, said fixedly connecting means includes a mounting block on said single pivot means, one said string cam fastened to each side of said mounting block, and said removable fastening means including fasteners attaching said string cams to said mounting block.

12. A compound bow according to claim 11 wherein, said pivot means includes an axle, and said axle disposed through said mounting block.

13. A compound bow according to claim 1 including, a pair of alternate power cams provided with differently profiled tracks, a releasable means connecting said power cable ends joined to said power cams whereby, upon manipulation of said releasable means and removal of said fastening means, said power cams may be removed from said cam assembly to accommodate said alternate power cams to vary the bow draw length.

14. A compound bow according to claim 13 wherein, said single pivot means includes an axle supporting said cam assembly, and said power cams provided with a slotted aperture radially engageable with said axle to permit removal of said power cams without removal of said axle.

15. A compound bow according to claim 1 wherein, one said end of each said power cable is joined to its respective limb tip in a symmetrical manner relative the bow centerline.

16. A compound bow according to claim 15 including, a bridle cable connecting one said end of each said power cable to its respective limb tip.

17. A compound bow according to claim 1 wherein, said string and power cams include four separable integral members each comprising an elongated planar element and said profiled track in all said cams defines an irregular non-circular configuration.

18. A compound bow according to claim 1 wherein, said cam assembly is angularly displaced about said pivot means less than 180° as said bowstring is drawn from brace height to full draw.

* * * * *